US007623018B2

(12) United States Patent
Yang

(10) Patent No.: US 7,623,018 B2
(45) Date of Patent: Nov. 24, 2009

(54) SLIM FILTER INDUCTOR FOR ELECTRONIC BALLAST

(76) Inventor: Kevin J. Yang, 1225 Via Coronel, Palos Verdes Est., CA (US) 90274

( * ) Notice: Subject to any disclaimer, the term of this patent is extended or adjusted under 35 U.S.C. 154(b) by 668 days.

(21) Appl. No.: 11/391,854

(22) Filed: Mar. 29, 2006

(65) Prior Publication Data

US 2007/0171018 A1 Jul. 26, 2007

(30) Foreign Application Priority Data

Jan. 26, 2006 (CN) ..... 2006 2 0039305 U

(51) Int. Cl.
*H01F 27/24* (2006.01)

(52) U.S. Cl. ..... 336/234

(58) Field of Classification Search ..... 336/212, 336/234

See application file for complete search history.

(56) References Cited

U.S. PATENT DOCUMENTS 4,480,377 A * 11/1984 House et al. ..... 29/593

5,861,792 A * 1/1999 Ueda et al. ..... 336/234

FOREIGN PATENT DOCUMENTS

JP 55138819 A * 10/1980

* cited by examiner

*Primary Examiner*—Tuyen Nguyen
(74) *Attorney, Agent, or Firm*—Clement Cheng

(57) ABSTRACT

Technology presented in the following utility patent yields a significant innovation within the field of electrical lighting. An alternative configuration of the filter inductor, which serves as part of a passive power factor correction circuit, increases the overall efficiency of fluorescent ballast. The core of the inductor is essentially comprised of a vertically positioned, laminated silicon steel stack within the electronic ballast housing. The vertical orientation allows for a significant reduction in the height and width of the ballast housing, thus creating more effective use of space. Furthermore, each individual laminated silicon steel plate's outside corner angles assume a crescent moon shape. This unique structure serves to provide additional space for the ballast's input lead wires by forming total three (3) of long narrow channels. In order to balance any offset in magnetic flux density caused by the crescent moon shape, the two alternate interior angles of the sheet are arc-shaped.

1 Claim, 1 Drawing Sheet

SLIM FILTER INDUCTOR FOR ELECTRONIC BALLAST

FIELD OF THE INVENTION

Technology proposed in the following utility patent yields a significant innovation within the field of electrical lighting. An alternative configuration of the filter inductor, which serves as part of a passive power factor correction circuit, increases the overall efficiency of fluorescent lamps.

In order to convert power from alternate current (AC) to direct current (DC), the typical non-power factor correction (NPFC) power supply utilizes a standard AC/DC circuit. Such circuits consist of a both a bridge diode rectifier and an electrolytic capacitor that essentially functions as a DC filter capacitor. This standard model brings forth a fundamental problem that hinders the overall efficacy of the design. Within a standard AC/DC circuit, AC current can only flow if the input voltage is greater than the given electrolytic capacitor's holding voltage. The internal rectify diodes are thus conducted with a mere one-fifth of each cycle time, causing the formation of narrow discretetive wavelengths. These current waves essentially reflect a high-peak pulsation pattern and emanate an undesirable amount of harmonic distortion. The distortion is caused by a significant disparity in the typical power factor and the total harmonic distortion (THD) within the circuit. The average power factor in an AC/DC circuit is approximately fifty percent, while the THD can reach as high as one hundred and fifty percent of the basic line current. Such harmonic interference in large quantities can potentially cause a electrical power line burned down, due to the neuter line's heavily overload as the direct consequence of high THD.

In an effort to assess and reduce this risk, power fact correction (PFC) circuits were designed and eventually deemed requisite for large commercial and industrial areas. PFC circuits are currently used in various types of electronic power supply circuits, including the electronic ballast cited within this application. The passive PFC circuit's effectiveness in improving the disparity of the power factor and THD is demonstrated in FIG. 1. This simple design encompasses both a differential mode filter inductor as the current filter (shown as L1 in FIG. 1) and a filter film capacitor (shown as C1 in FIG. 1). This model can effectively raise the power factor to above ninety eight percent (>98%) and lower the total harmonic distortion to below twenty percent (<20%), which completely eliminating all previously mentioned risks associated with traditional AC/DC circuits.

FIG. 1, L1 displays an inductor from prior art. This inductor constitutes a key component of the passive power factor circuit (PPFC), and is commonly used in contemporary PPFC electronic ballasts. The PPFC electronic ballasts play very important role in today's fluorescent lighting business.

The filter inductor displayed in prior art can come in various sizes, depending on the estimated level of input power. Inductor size is typically measured by the given cross-section of the core; a stack of laminated silicon steel. The core size of a filter inductor can be precisely calculated for the various models, contingent upon on the power capacity of the electronic ballast. As a common rule of thumb, a higher power input generally requires a larger core size.

The filter inductors of electronic ballasts in all prior art have a virtually identical core design. The laminated steel plates are horizontally aligned into a stack, as shown in FIG. 2. This structure was initially implemented to simplify the assembly process of such inductors, however it also inadvertently hinders the ballast power by restricting the size of the ballast housing. This is displayed in the height (H) and width (W) dimensions in FIG. 2. The current design also renders a reduction in ballast enclosure size unfeasible, due to the same principle.

FIG. 3 represents a new and innovative configuration, which varies from the typical design for several practical reasons. The proposed invention converts the laminated silicon stack of steel plates from a horizontal position to a vertical position, allowing for significantly larger steel plate cores to fit in smaller casing.

The present invention enables more efficient use of the electronic ballast housing than the previous inductor design. Hence, electronic ballast with a higher power capacity can now be housed within a smaller space. This is significant because the ballast housing dimensions are typically the largest restriction in compatibility with lamps and lighting fixtures on the market. Most fixtures have ballast width and height restrictions, due to lamp size. Furthermore, smaller dimensions have become a perpetual trend amongst fluorescent lighting. The successful progression from a T12 lamp (1.50" in diameter) to a T8 lamp (1.0" in diameter), has yielded the present development of the T5 lamp which is only 0.625" in diameter. The smaller lamp dimensions create an impending demand for supplemental technological advancement, and the proposed invention fulfills this need by miniaturizing the inductor's core for the smaller of electronic ballast housing.

SUMMARY OF THE INVENTION

Figure 1:
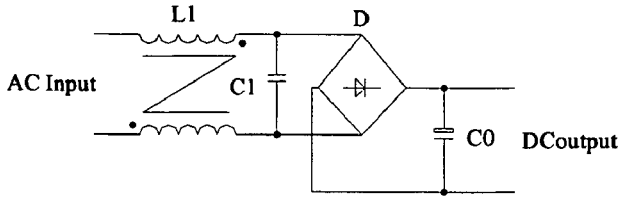
FIG. 1 is a typical passive power factor correction circuit. L1 signifies the differential mode filter inductor and C1 represents the filter film capacitor.
Figure 2:
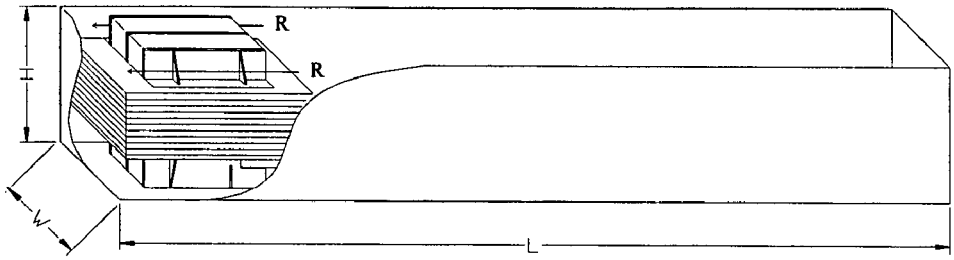
FIG. 2 is a drawing of a typical filter inductor, specifically highlighting the configuration within electronic ballast housing.
Figure 3:
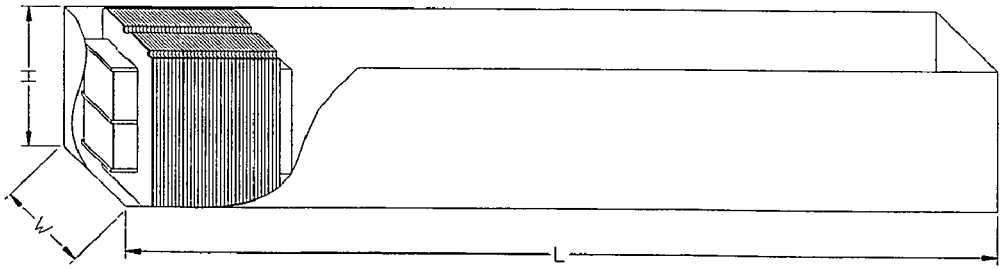
FIG. 3 is the present invention, a new configuration that specifically highlights the inverted orientation of the core within electronic ballast housing. The drawing also indicates the possibility of enlarging the filter inductor, which is to lengthen the laminated plate steel stack without affecting the ballast's width and height.
Figure 4:
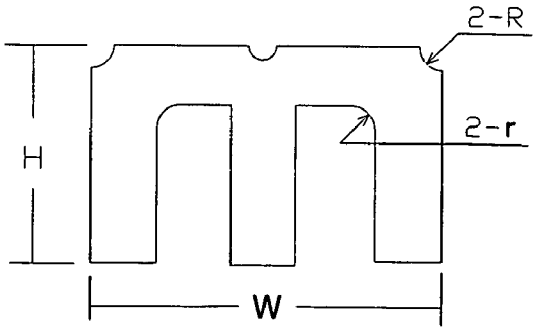
FIG. 4 is a detailed drawing of each E-shaped laminated silicon steel plate.

The utility patent is essentially a reconfigured filter inductor for an electronic ballast with passive power factor correction (PFC) circuit. The laminated silicon steel plates that comprise the core of the inductor are positioned in vertical, rather than horizontal, structure. The core consists of numerous E-shaped silicon steel single plates, as shown in FIG. 4. Each individual plate's outside corner angles assume a crescent moon shape, thus reducing the width. In order to balance any offset in magnetic flux density caused by such width reduction, the interior two angles of the sheet are shaped in the form of an arc. These complementary angles are depicted as (2-R) and (2-r), respectively, in FIG. 4. The coil structure of the inductor is also shaped accordingly to the interior angle radius.

DETAILED DESCRIPTION OF THE PREFERRED EMBODIMENT

The electronic ballast with passive power factor inductor has a vertical, rather than a traditional horizontal, orientation within the ballast housing. The planar plates are stacked in a manner wherein the faces of the plates are vertically positioned. Additional plates can easily be added to compensate for an increased demand for power capacity without contributing to height and width of the ballast housing.

FIG. 4 shows the intricate details of an individual laminated silicon steel sheet. The top two outside angles assume a crescent moon shape. This unique structure serves to provide additional space for the ballast's input lead wires by forming long narrow open channels.

In order to balance any offset in magnetic flux density caused by such width reduction, the interior two angles of the sheet are shaped in the form of an arc. These complementary angles are depicted as (2-R) and (2-r), respectively, in FIG. 4. The coil structure of the inductor is also shaped according to the interior angle radius. The ideal dimension of the ballast housing for the present invention is approximately thirty millimeters (33 mm or 1.3 inch) in width; about twenty four percent (24%) less than the current standard fluorescent lamp ballast housing of forty-two millimeters (42 mm or 1.7 inch). The seventeen percent reduction (17%) in average height can also be attained by implementation of the proposed structural innovation.

The invention claimed is:

1. An electronic ballast comprising: a ballast housing; and an inductor, wherein the inductor has a plate stack having a vertical lamination structure for its low frequency magnetic core, wherein ballast power rating affects a plate stack length, but not the plate stack width or the plate stack height, wherein the plate stack comprises a plurality of E bar and I bar shaped steel plates laminated into a stack; wherein the plate stack comprises a corner cut out in at least one corner of the plate stack in the E bar forming a channel to receive electronic ballast input lead wire, further comprising at least one additional corner cut out to comprise a total of at least one two corner cut outs forming two channels, wherein the corner cut out assumes a crescent moon shape, wherein the dimension of the ballast housing for the present invention is approximately thirty millimeters in width and about twenty four percent less than the current standard fluorescent lamp ballast housing of forty-two millimeters.

* * * * *